US008847572B2

(12) United States Patent
Tsai

(10) Patent No.: US 8,847,572 B2
(45) Date of Patent: Sep. 30, 2014

(54) OPTIMIZATION METHODOLOGY AND APPARATUS FOR WIDE-SWING CURRENT MIRROR WITH WIDE CURRENT RANGE

(75) Inventor: Tsung-Hsien Tsai, Kaohsiung (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 48 days.

(21) Appl. No.: 13/554,043

(22) Filed: Jul. 20, 2012

(65) Prior Publication Data

US 2013/0271106 A1 Oct. 17, 2013

Related U.S. Application Data

(60) Provisional application No. 61/623,693, filed on Apr. 13, 2012.

(51) Int. Cl.
*G05F 1/10* (2006.01)

(52) U.S. Cl.
USPC ..... 323/317; 323/315

(58) Field of Classification Search
USPC ..... 323/315, 317
See application file for complete search history.

(56) References Cited

U.S. PATENT DOCUMENTS

| | | | | |
|---|---|---|---|---|
| 4,608,530 | A * | 8/1986 | Bacrania | 323/315 |
| 4,983,929 | A * | 1/1991 | Real et al. | 330/288 |
| 5,581,209 | A * | 12/1996 | McClure | 327/538 |
| 6,462,527 | B1 * | 10/2002 | Maneatis | 323/315 |
| 7,208,998 | B2 * | 4/2007 | Abel | 327/538 |
| 7,336,133 | B2 * | 2/2008 | Shor | 330/288 |
| 7,352,245 | B2 * | 4/2008 | Shih et al. | 330/288 |
| 7,489,181 | B2 * | 2/2009 | Pastorina et al. | 327/530 |
| 7,514,989 | B1 * | 4/2009 | Somerville et al. | 327/543 |
| 7,535,258 | B1 * | 5/2009 | Johnson et al. | 326/82 |
| 7,551,012 | B2 * | 6/2009 | Mai et al. | 327/158 |
| 7,649,419 | B2 * | 1/2010 | Hoelzle et al. | 330/288 |
| 7,876,133 | B1 * | 1/2011 | McLaughlin et al. | 327/112 |
| 7,893,853 | B2 * | 2/2011 | Lai et al. | 341/120 |
| 7,956,695 | B1 * | 6/2011 | Ding et al. | 331/17 |
| 8,138,822 | B1 * | 3/2012 | Cyrusian | 327/538 |
| 8,456,227 | B2 * | 6/2013 | Hirashiki et al. | 327/543 |
| 2007/0018701 | A1 * | 1/2007 | Abbasi et al. | 327/157 |
| 2011/0273231 | A1 * | 11/2011 | Nakamura | 330/257 |
| 2012/0119063 | A1 * | 5/2012 | Takamiya et al. | 250/208.1 |
| 2012/0235733 | A1 * | 9/2012 | Nakamoto | 327/541 |
| 2013/0154684 | A1 * | 6/2013 | Cho et al. | 326/29 |

* cited by examiner

*Primary Examiner* — Thomas J Hiltunen
(74) *Attorney, Agent, or Firm* — Eschweiler & Associates, LLC

(57) ABSTRACT

A current mirror circuit includes an input portion configured to conduct a bias current, and a first current source circuit coupled to the input portion and configured to generate the bias current, and vary the bias current over a range of currents based on a first group of weightings associated therewith. The current mirror circuit also includes an output portion configured to conduct an operational current, wherein the output portion is coupled to the input portion, and a second current source circuit coupled to the output portion and configured to generate the operational current, and vary the operational current over a range of currents based on a second group of weightings associated therewith. The first group of weightings and the second group of weightings are different.

20 Claims, 8 Drawing Sheets

OPTIMIZATION METHODOLOGY AND APPARATUS FOR WIDE-SWING CURRENT MIRROR WITH WIDE CURRENT RANGE

REFERENCE TO RELATED APPLICATIONS

This application claims priority to provisional patent application No. 61/623,693, filed Apr. 13, 2012, the contents of which are hereby incorporated by reference in its entirety.

BACKGROUND

In circuit design, current mirrors are employed to copy current to one or more nodes in a circuit. It is desirable for such circuits to exhibit satisfactory performance characteristics across a range of operating conditions.

DETAILED DESCRIPTION

Figure 1:
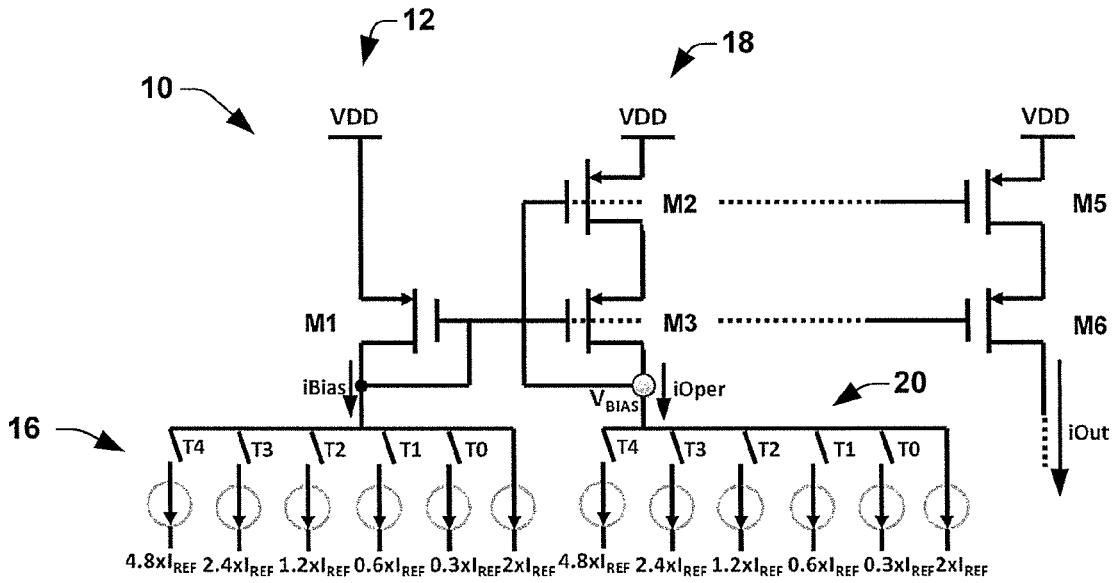
FIG. 1 is a circuit diagram of a MOS type current mirror circuit.

One or more implementations of the present invention will now be described with reference to the attached drawings, wherein like reference numerals are used to refer to like elements throughout. The drawings are not necessarily drawn to scale.

A current mirror circuit is a widely used circuit configuration that is designed to copy a current through one active device by controlling a current in another active device in the circuit. Further, it is desirable that the output current be kept relatively constant regardless of loading. Depending on relative transistor sizing, a transfer ratio may be dictated, thereby rendering a current mirror a current amplifier. For a current mirror in which the input current and the output current are equal, the transfer ratio is "1", and the current mirror is a unity gain current amplifier. For a non-unity transfer ratio of "n", the output current is always "n" times the input current, or bias current of the current mirror circuit.

A wide-swing current mirror circuit is one in which the input current, or bias current, can vary over a substantial range of currents. It has been ascertained by the inventors of the present disclosure that at larger input currents the output resistance ($R_{OUT}$) of the current mirror undesirably decreases. It has been determined that for higher values of the input current ($I_{BIAS}$), and thus higher value of the output current ($I_{OPER}$), the output resistance ($R_{OUT}$) is reduced because a transistor in the current mirror circuit falls out of saturation.

A traditional MOS type wide-swing current mirror is illustrated in FIG. 1, at reference numeral 10. The current mirror circuit 10 has an input section 12 comprised of a first transistor M1 that conducts a bias current ($I_{BIAS}$) that is dictated by a programmable current source circuit 16. Thus $I_{BIAS}$ can be varied from a value, in this example, of $2\times I_{REF}$ to a value $11.3\times I_{REF}$ (e.g., about 10 μA to about 40 μA). An output portion 18 has a second transistor M2 and a third transistor M3 connected together in series and transistors M5 and M6 also connected in series, wherein the gate terminals of the first transistor M1 and the second and third transistors M2 and M3 are connected together. A programmable current source circuit 20 is also coupled to the output portion 18 of the current mirror circuit 10, wherein the switching control functionality is the same as the input programmable current source 16. In such manner, $I_{BIAS}=I_{OPER}$ for all varying values of $I_{BIAS}$ across the range $2\times I_{REF}$ to $11.3\times I_{REF}$ in this example.

For proper operation both the second transistor M2 and the third transistor M3 must operate in saturation for varying values of $I_{BIAS}$. For transistor M2 and M3 to be in saturation, the following conditions must be established:

$$V_{GS}(M1)+V_{TH}(M2)>V_{GS}(M2)+V_{GS}(M3), \text{ and}$$

$$V_{GS}(M1)<V_{GS}(M2)+V_{TH}(M3).$$

Figure 2:
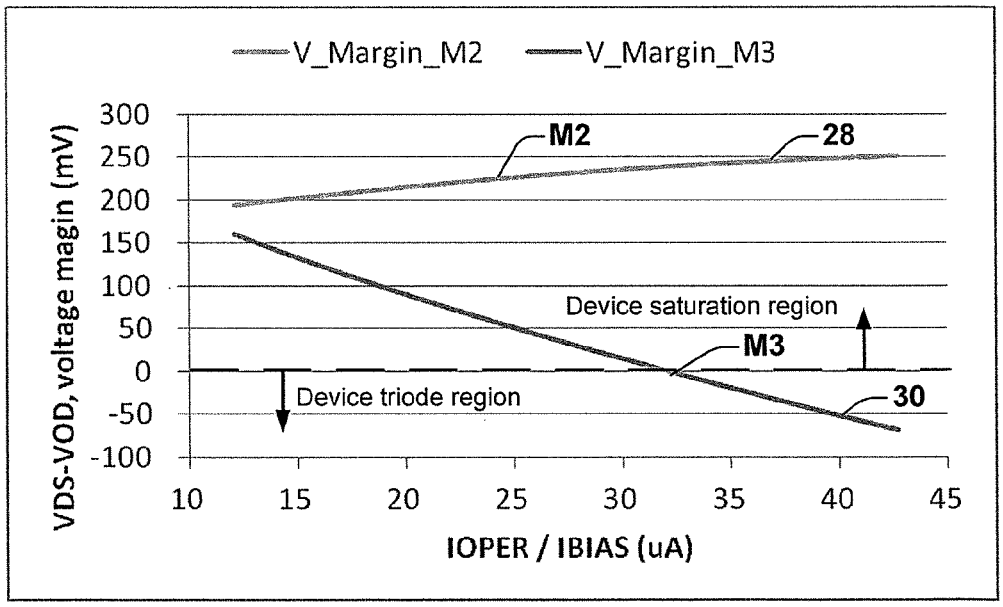
FIG. 2 is a graph illustrating transistor in the current mirror circuit of FIG. 1 entering the triode region at large current mirror operating currents.
Figure 3:
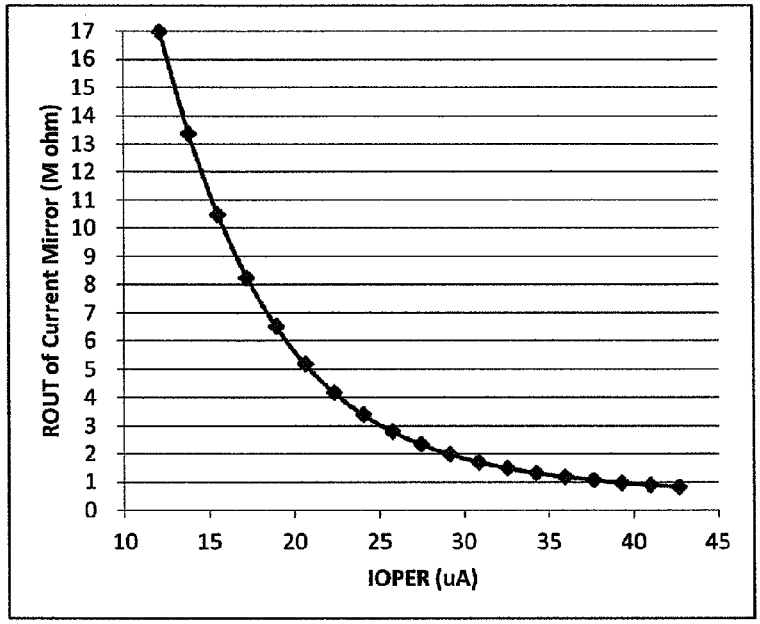
FIG. 3 is a graph illustrating how the output resistant ROUT of the current mirror circuit of FIG. 1 declines at large current mirror operating currents.

However, it has been found that for large values of $I_{OPER}$ (and thus large values of $V_{GS}(M1)>V_{GS}(M2)+V_{TH}(M3)$, which causes the third transistor M3 to enter the triode region, which is also referred to as the liner region. It has also been determined that the root cause of the degradation in output resistance $R_{OUT}$ is caused by the voltage margin ($V_{DS}-V_{OD}$) of the third transistor M3 not staying positive for all values of $I_{BIAS}$, at which point the third transistor M3 exits the saturation region of operation. This can been seen in FIG. 2, wherein the voltage margin for both transistors M2 and M3 of FIG. 1 are measured across a range of $I_{BIAS}$ (wherein $I_{BIAS}=I_{OPER}$) from about 10 μA to about 40 μA. As illustrated in FIG. 2, the voltage margin 28 for transistor M2 stays at about 200 mV or more for all values of $I_{BIAS}$, while the voltage margin 30 of the third transistor M3 falls below 0V for values of $I_{BIAS}$ of about 30 μA or more, thereby driving transistor M3 into the triode region. Viewing FIG. 2 in conjunction with FIG. 3, the decrease in output resistance $R_{OUT}$ is seen for high operating currents.

Figure 4:
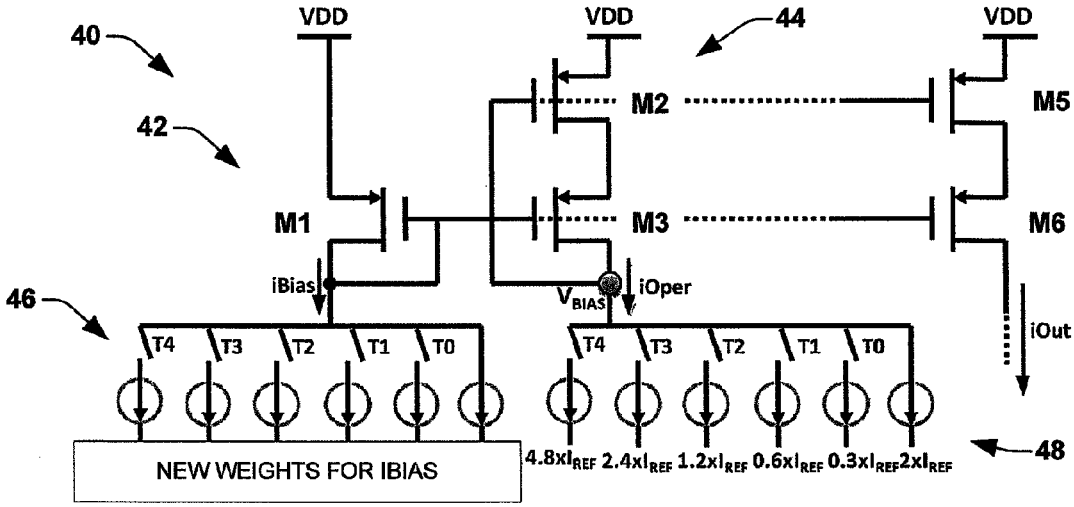
FIG. 4 is a circuit diagram illustrating a MOS type current mirror circuit according to one embodiment that employs differing weighting for a bias portion of the circuit compared to an output portion of the circuit, such that a slope of the bias current to the operating current is varied.
Figure 5:
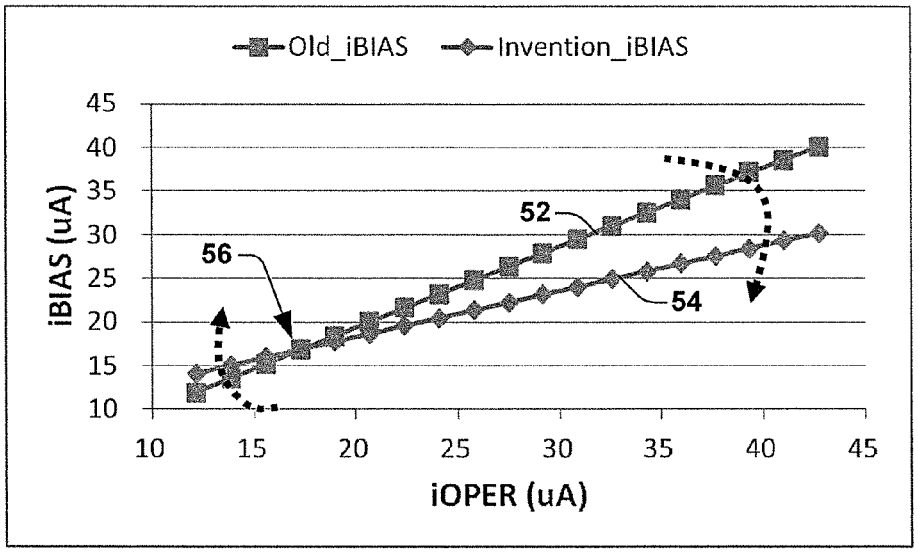
FIG. 5 is a graph illustrating a slope of the bias current to the operating current for a convention current mirror circuit compared to a reduced slope of the bias current to the operating current of a current mirror according to one embodiment of the present disclosure.

FIG. 4 is a schematic diagram of a current mirror circuit 40 according to one embodiment of the disclosure. The current mirror circuit 40 comprises an input portion 42 that includes a first transistor M1 and an output portion 44 that includes series-connected second and third transistors M2 and M3 and series-connected transistors M5 and M6. The input portion 42 generates an input current or bias current $I_{BIAS}$ that is dictated by a first programmable current source 46, and the output portion generates an operational current $I_{OPER}$ that is a function of a second programmable current source 48. In contrast with the current mirror circuit 10 of FIG. 1, the current mirror circuit 40 of FIG. 4 exhibits different weightings in the first and second current sources 46 and 48, respectively. This results in an operational current $I_{OPER}$ that varies at a rate that is different than that of the bias current $I_{BIAS}$. This behavior is illustrated in FIG. 5. Curve 52 represents the behavior of the conventional current mirror circuit 10 of FIG. 1. For all varying values of $I_{BIAS}$, $I_{OPER}$ was equal thereto. That is, $I_{BIAS}=I_{OPER}$ for all differing values of $I_{BIAS}$. Thus the slope of curve 52 is "1." In contrast, curve 54 represents operation of the current mirror circuit 40 of FIG. 4, wherein the first current source 46 has a different weighting than the second current source 48. As illustrated in the example of FIG. 5, the curve 54 has an "axel" or "pivot point" 56 about which curve 54 is "rotated" downwards with respect to curve 52. Thus for values below approximately 17.5 μA, $I_{BIAS}>I_{OPER}$, while for output currents greater than 17.5 μA, $I_{OPER}>I_{BIAS}$. At the pivot point 56, $I_{BIAS}=I_{OPER}$. As can be seen in curve 54 in FIG. 5, the slope of the curve has been rotated to a value <1, and this change in the slope is dictated by the different weightings provided in the current sources 46 and 48 of FIG. 4.

While the current mirror circuit 40 of FIG. 4 illustrates current source circuit 48 weighting being maintained and the current source circuit 46 being changed with respect to weighting, it should be understood that either or both current sources 46 and 48 may be changed with respect to their weightings so that a rate at which $I_{OPER}$ changes is different than that of $I_{BIAS}$.

Figure 6:
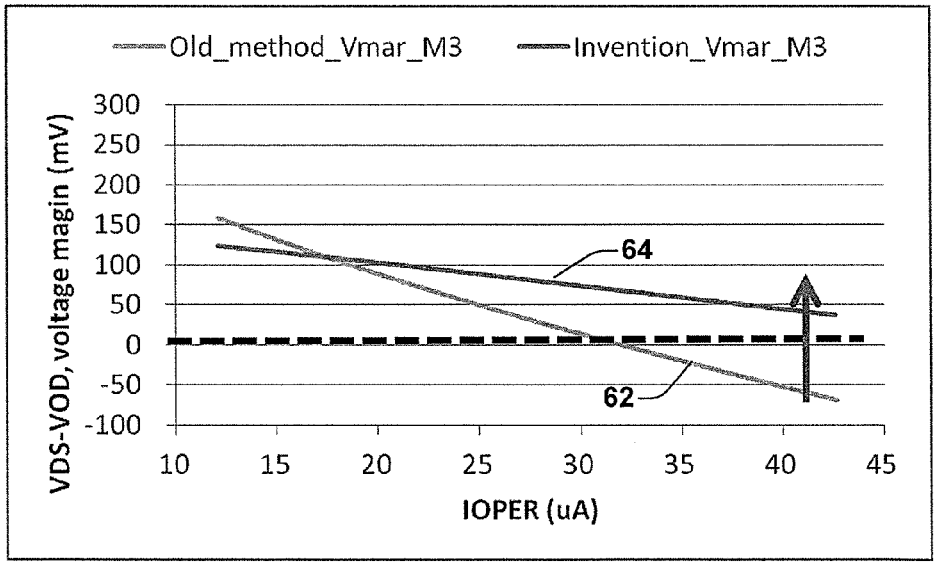
FIG. 6 is a graph illustrating how the current mirror circuit of FIG. 4 exhibits an increased voltage margin over a range of operating current, thereby causing an transistor in an output portion of the current mirror to remain in saturation.

Referring to FIGS. 5 and 6 concurrently, due to a rotation of the slope from curve 52 (a slope of 1) to that of curve 54 (a slope <1), the voltage margin of the third transistor M3 in FIG. 4 decreases more modestly (at a slower rate) than the conventional solution of FIG. 1. Thus as shown in FIG. 6, while the voltage margin of M3 of FIG. 1 decreases below 0 mV on trace 62 at higher output currents, the voltage margin of transistor M3 of FIG. 4 decreases, but more slowly on trace 64, and thus remains positive even at higher operational currents.

Figure 7:
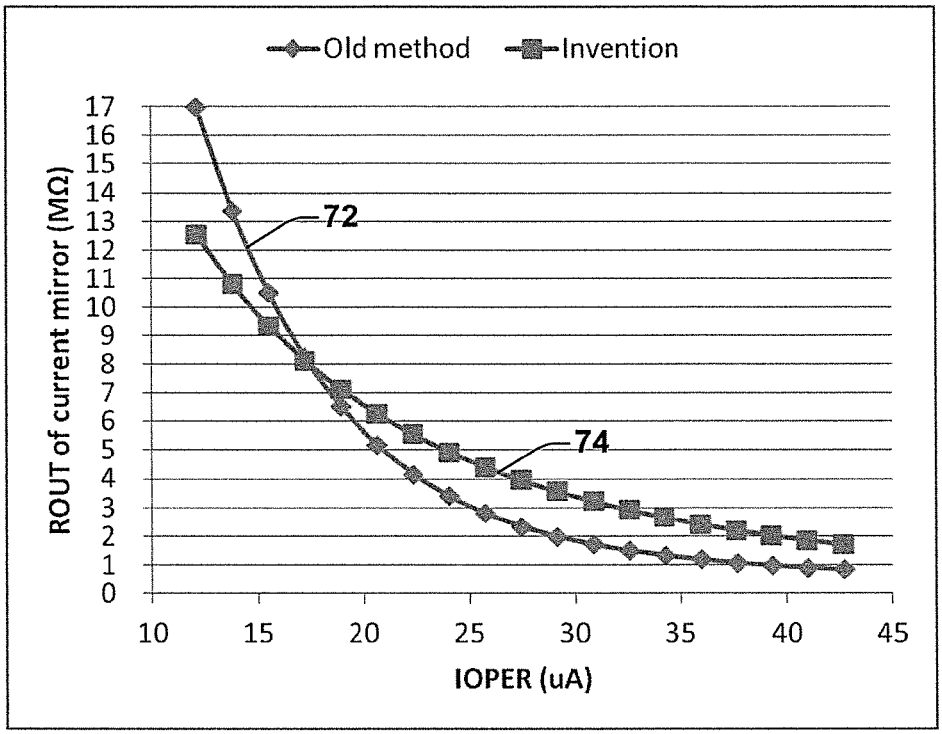
FIG. 7 is a graph illustrating the output resistance $R_{OUT}$ of the current mirror circuit of FIG. 4 compared to the output resistance $R_{OUT}$ of the current mirror of FIG. 1.
Figure 8:
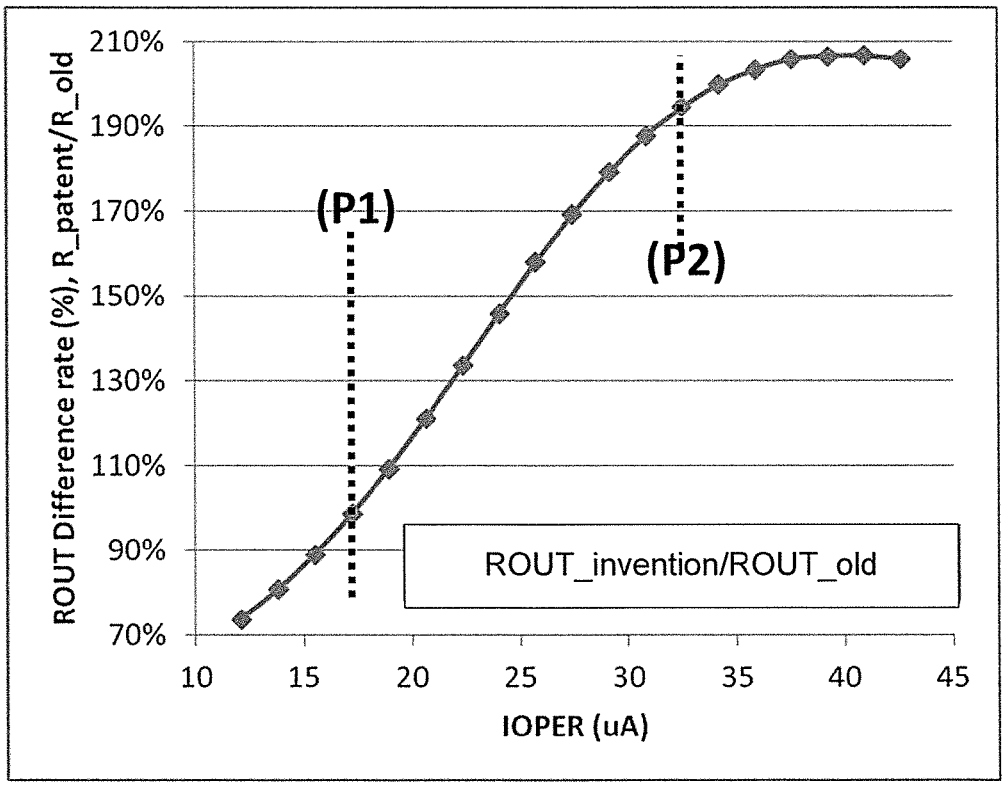
FIG. 8 is a graph illustrating a different in the output resistance $R_{OUT}$ in terms of percentage of the current mirror circuit of FIG. 4 to that of the current mirror of FIG. 1.

With the voltage margin of transistor M3 of FIG. 4 staying positive across the range of output currents, transistor M3 remains in saturation, which mitigates the reduction in the output resistance $R_{OUT}$ of the current mirror circuit 40. This behavior is illustrated in greater detail in FIGS. 7 and 8. In FIG. 7, the output resistance $R_{OUT}$ for the current mirror circuit 10 of FIG. 1 is illustrated at 72, while the output resistance $R_{OUT}$ for the current mirror circuit 40 of FIG. 4 Is illustrated at 74. As seen in FIG. 7, at high operational currents $I_{OPER}$, the output resistance $R_{OUT}$ 72 decreases aggressively, while the output resistance $R_{OUT}$ 74 decreases less aggressively, such that at large operational currents the output resistance $R_{OUT}$ 74 of the current mirror circuit 40 of FIG. 4 is about 2× that of the current mirror circuit 10 of FIG. 1. This is clearly shown in FIG. 8, wherein at point P1 the $R_{OUT}$ 72 and $R_{OUT}$ 74 are equal and thus $R_{OUT}$ 74 is 100% that of $R_{OUT}$ 72. At lower currents $R_{OUT}$ 74 is less than $R_{OUT}$ 72 and thus its percentage of $R_{OUT}$ 72 is less than 100%. At point P2 where the operating current $I_{OPER}$ is high (e.g., about 30-35 μA), $R_{OUT}$ 74 is about 2× that of $R_{OUT}$ 72 and thus the percentage of $R_{OUT}$ 74 with respect to $R_{OUT}$ 72 is nearly 200%. This two-fold increase in output resistance of current mirror circuit 40 is a significant improvement in performance for a wide-range current mirror.

Figure 9:
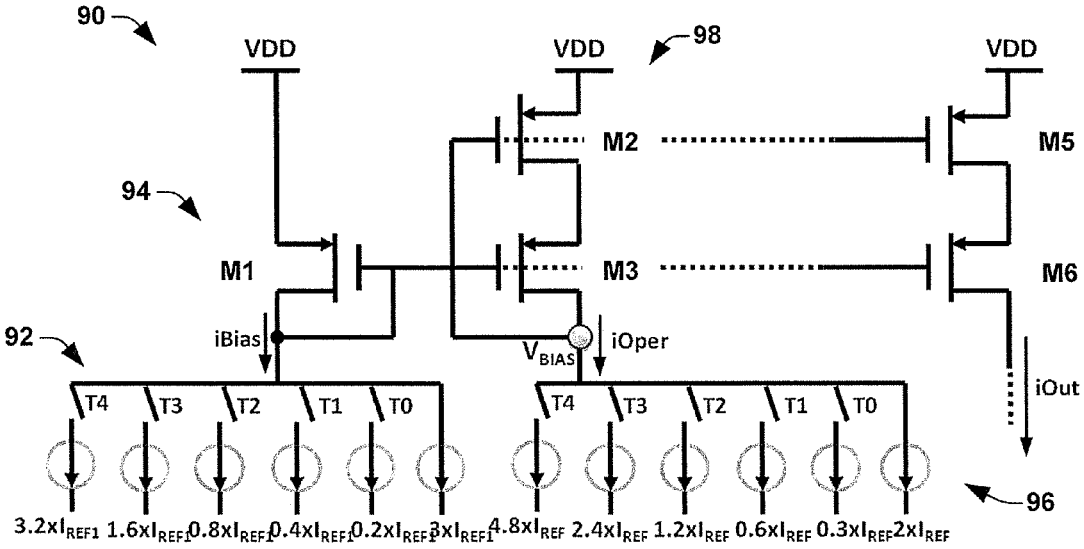
FIG. 9 is a schematic diagram illustrating a current mirror circuit employing first and second current sources having differing weightings according to one embodiment of the disclosure.

FIG. 9 is a schematic diagram of a current mirror circuit 90 according to one embodiment of the disclosure, wherein a first current source 92 at an input portion 94 is weighted differently than a second current source 96 at an output portion 98. More particularly, the first current source 92 is binary weighted in one embodiment, wherein a 5-bit digital control word permits $2^5$ different $I_{BIAS}$ currents, wherein if a the 5-bit control word is "00000," switches T0, T1, T2, T3 and T4 are all open, and $I_{BIAS}=3\times I_{REF}$. Likewise, if the 5-bit word is "11111," switches T0, T1, T2, T3 and T4 are all closed and $I_{BIAS}=3\times I_{REF}+0.2\times I_{REF}+0.4\times I_{REF}+0.8\times I_{REF}+1.6\times I_{REF}+3.2\times I_{REF}=9.2\times I_{REF}$. Thus a reference current IREF is provided to the current source circuit 92, and an $I_{BIAS}$ is generated by the current mirror 90 based on the 5-bit programming word provided thereto. While the embodiment of FIG. 9 provides five switched currents and thus a 5-bit control word, an n-bit configuration is contemplated, wherein n is an integer greater than zero.

Still referring to FIG. 9, the output portion 98 generates an operational current $I_{OPER}$ based on the 5-bit control word provided to the second programmable current source 96. Notably, the weightings of the current source paths or branches in the second current source 96 are different than the first current source 92. More particularly, if the 5-bit control word is "00000" the output current is $I_{OPER}=2\times I_{REF}$, and if the 5-bit control word is "11111" the output current is $I_{OPER}=2\times I_{REF}+0.3\times I_{REF}+0.6\times I_{REF}+1.2\times I_{REF}+2.4\times I_{REF}+4.8\times I_{REF}=11.3\times I_{REF}$. As can be seen from the different weightings of the current sources 92 and 96 at "00000", $I_{BIAS}>I_{OPER}$, while at "11111", $I_{OPER}>I_{BIAS}$, and thus the slopes of the currents over the operating range are different from one another. For example, referring to FIG. 10, the graph illustrates $I_{BIAS}$ 102 for varying values TF of a digital control word provided to the current sources 92 and 96 of FIG. 9. Similarly, the graph also illustrates $I_{OPER}$ 104 for varying values TF of the digital control word. As can be seen, the rate at which $I_{OPER}$ increases is greater than the rate of increase of $I_{BIAS}$ due to the differing weighting of the current sources 92 and 96. In this manner the voltage margin of M3 stays positive across the entire range of operating currents, thus maintaining transistor M3 in saturation and improving the output resistance $R_{OUT}$ at large operational currents.

Figure 10:
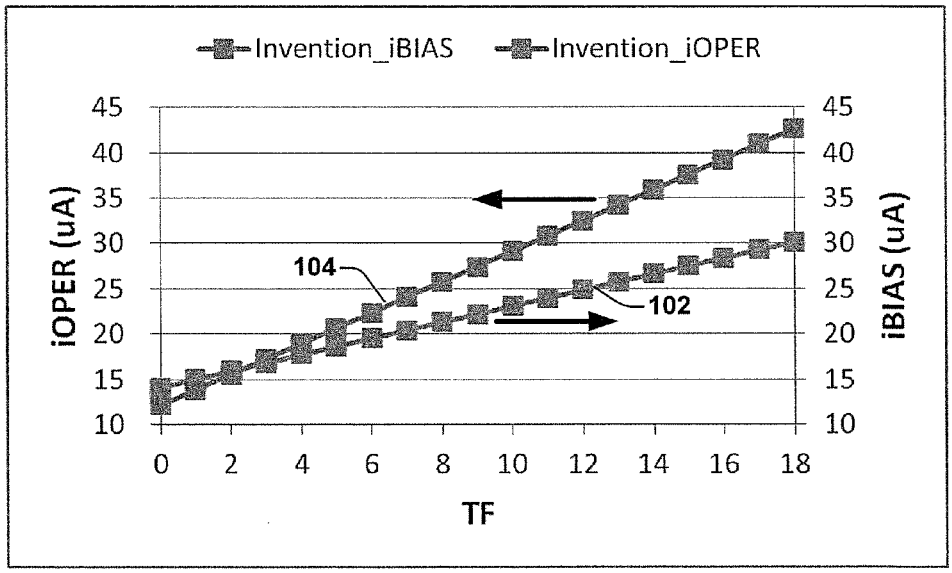
FIG. 10 is a graph illustrating the rate of change of the bias current and the rate of change of the operational current as a function of a control word for the current mirror circuit of FIG. 9.
Figure 11:
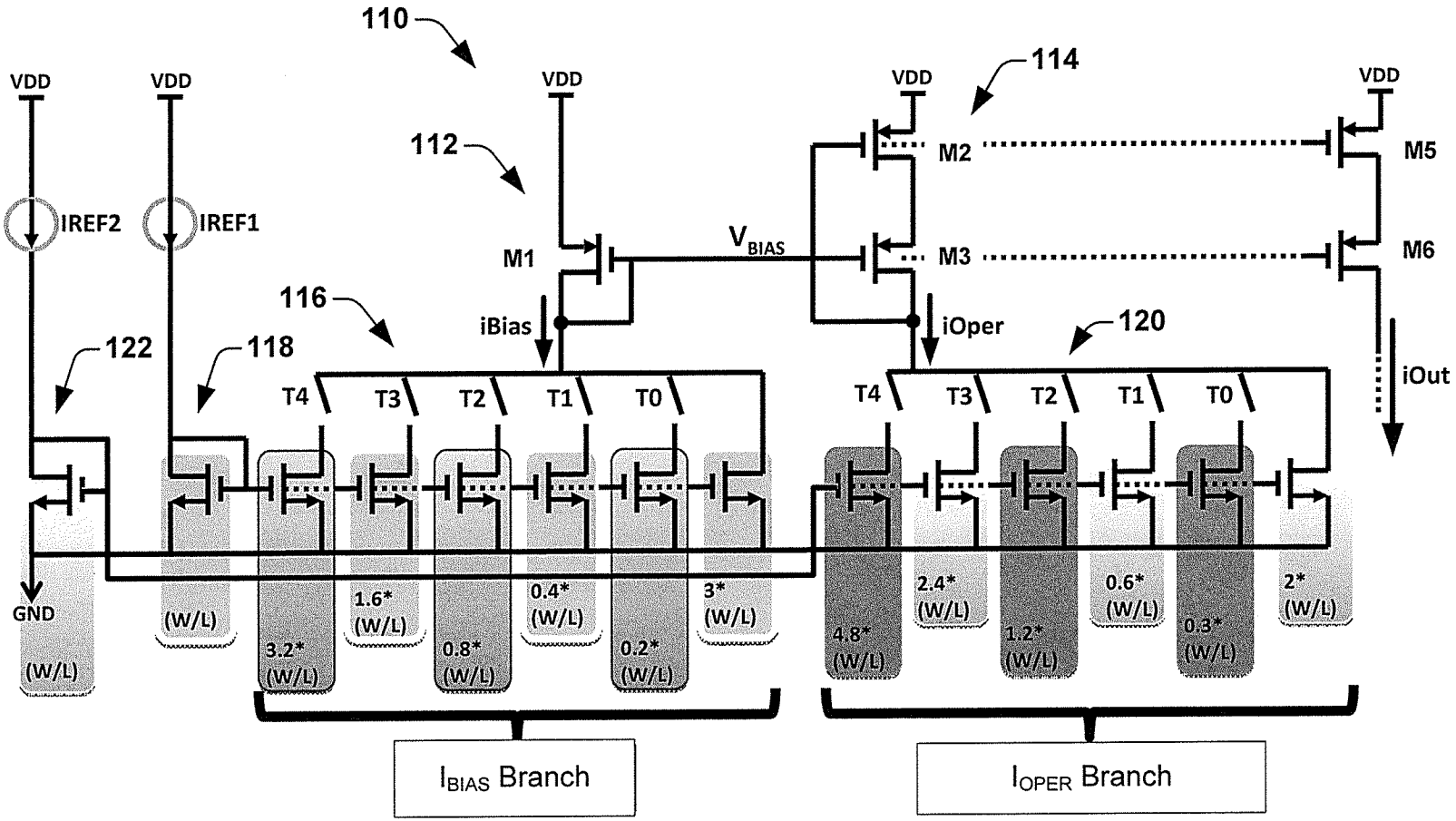
FIG. 11 is a schematic diagram illustrating a PMOS current mirror circuit employing first and second current sources having differing weightings according to another embodiment of the disclosure.

FIG. 11 is a schematic diagram illustrating a current mirror circuit 110 according to yet another embodiment of the disclosure. The current mirror circuit 110 has an input portion 112 and an output portion 114. The input portion 112 has a first transistor M1, and the output portion 114 has series-connected second and third transistors M2 and M3, wherein M1 and M2, M3 are connected together via their respective gate terminals. The first transistor M1 is connected in series with a first current source circuit 116 having a first weighting associated therewith. Each branch of the first current source circuit 116 has a transistor therein either directly connected to M1, or selectively connected to M1 through a switch. Based on a control word provided to the first current source circuit 116, one or more switches may be closed, thereby selectively coupling various transistors together in parallel, wherein the parallel combination of transistors is in series with transistor M1. Each of the transistors in the first current source circuit 116 have a gate terminal that is connected to a gate terminal of a transistor 118 that forms a current mirror circuit therewith. In such manner, a first reference current $I_{REF1}$ is mirrored into the first current source circuit 116, wherein $I_{REF1}$ is amplified by a factor dictated by which transistors in the first current source circuit 116 are connected into the circuit via their switches. In this example, if the control word is "00000" $I_{BIAS}=3\times I_{REF1}$, and if the control word is "11111" $I_{BIAS}=9.2\times I_{REF1}$. Thus based on the control word, the first current source 116 is programmed to provide an $I_{BIAS}$ that can be varied across a wide range of currents. Further, as can be seen by the varied transistor sizes in the first current source circuit 116 binary weightings in one embodiment allow the control word to be incremented to provide for incremented currents in a relatively linear manner if desired. The weightings of the transistors in the first current mirror circuit 116 dictate a slope of $I_{BIAS}$ for incremental changes in the control word, for example, as illustrated at 102 in FIG. 10.

Still referring to FIG. 11, the output portion 114 of the current mirror circuit 110 has a second current source circuit 120 that has multiple branches associated therewith, wherein each branch has a transistor therein. The transistors in the various branches are either directly connected or selectively connected through switches to the third transistor M3. The various branches with closed switches are connected together in parallel to form the operation branch that dictates the output current $I_{OPER}$. The various transistors in the branches of the second current source 120 have different sizes, such that in one embodiment the transistor sizes provide a binary weighting so that incremental changes in the control word provide similar incremental changes in $I_{OPER}$. In the example of FIG. 11, a control word of "00000" results in $I_{OPER}=2\times I_{REF2}$, and a control word of "11111" results in $I_{OPER}=11.3\times I_{REF2}$. In the embodiment of FIG. 11, the second current source 120 is fed with a second reference current from a transistor 122 that forms a current mirror therewith. In one embodiment $I_{REF1}=I_{REF2}$, however, the two reference currents may differ from one another, and such variation is contemplated as falling within the scope of the present disclosure.

If $I_{REF1}=I_{REF2}=I_{REF}$, it can be seen that for a control word of "00000" $I_{OPER}=2\times I_{REF}$, while $I_{BIAS}=3\times I_{REF}$, and so $I_{BIAS}>I_{OPER}$. For a control word of "11111", $I_{OPER}=11.3\times I_{REF}$, while $I_{BIAS}=9.2\times I_{REF}$, and so $I_{OPER}>I_{BIAS}$. Thus the differing weightings of the first and second current sources 116 and 120 result in the rate of change of $I_{BIAS}$ to be less than the rate of change of $I_{OPER}$ per incremental change in the control word. With the differing weightings, the voltage margin of transistor M3 is maintained positive throughout the range of currents, thus maintaining M3 in saturation and improving $R_{OUT}$ at large operational currents.

The different weightings in transistor sizes in the first and second current sources 116 and 120 of FIG. 11 are merely examples. Any different sizes of the first and second current sources 116 and 120 that prevent the voltage margin of transistor M3 from going negative over the desired current operating range may be utilized and is contemplated as falling within the scope of the present disclosure.

Figure 12:
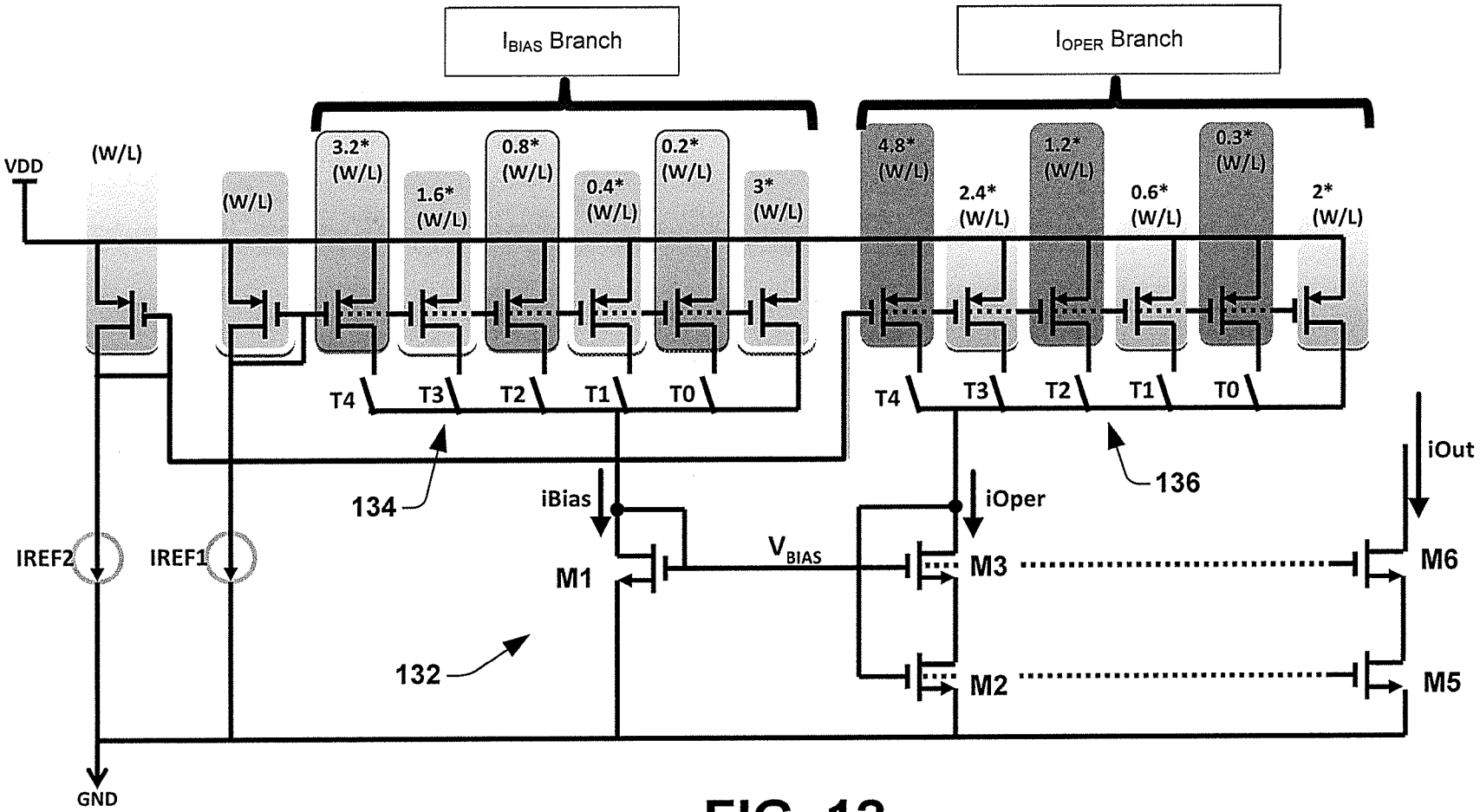
FIG. 12 is a schematic diagram illustrating an NMOS current mirror circuit employing first and second current sources having differing weightings according to another embodiment of the disclosure.

FIG. 11 illustrates a PMOS type current mirror circuit 110 with NMOS type transistors utilized in the first and second current sources 116 and 120. Alternatively, the present disclosure contemplates an NMOS type current mirror circuit 132 with PMOS type first and second current sources 134 and 136, respectively, as illustrated in FIG. 12. Similar to the embodiment of FIG. 11, the first and second current sources 134 and 136 of FIG. 12 have different weightings such that the $I_{BIAS}/I_{OPER}$ slope of FIG. 5 is effectively rotated. In the above manner, the operating margin of transistor M3 is kept positive, thus keeping M3 in saturation over the entire desired range of operating currents. In the above fashion, the output resistance of the current mirror circuit 132 is increased at large output currents.

Figure 13:
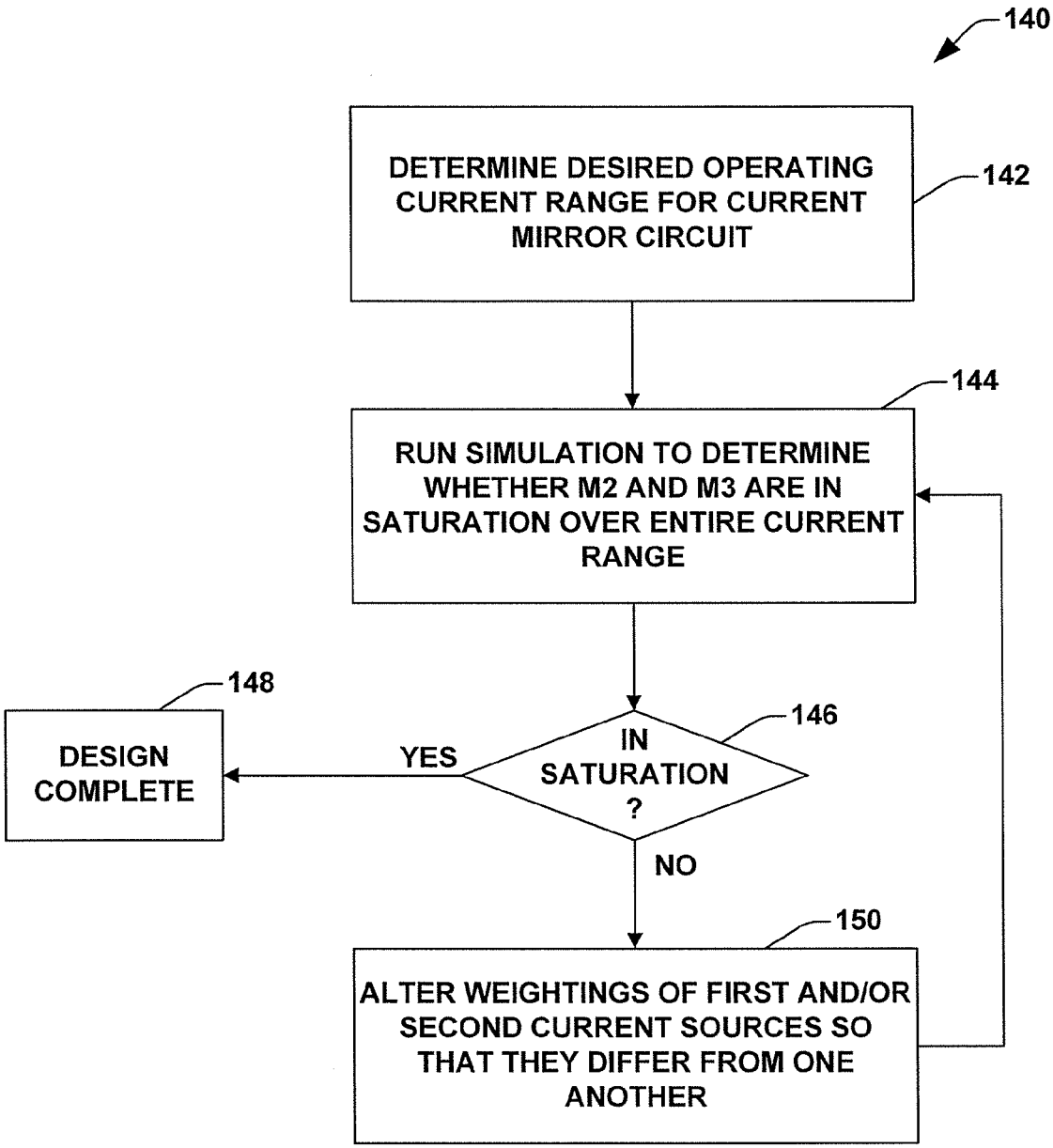
FIG. 13 is a flow chart illustrating a method of optimizing a current mirror circuit over a wide range of operating currents according to an embodiment of the disclosure.

Turning now to FIG. 13, a method of optimizing a wide-swing current mirror circuit is provided at 140. While the method 140 is illustrated and described below as a series of acts or events, it will be appreciated that the present disclosure is not limited by the illustrated ordering of such acts or events. For example, some acts may occur in different orders and/or concurrently with other acts or events apart from those illustrated and/or described herein, in accordance with the invention. In addition, not all illustrated steps may be required to implement a methodology in accordance with the present disclosure.

The method 140 starts at 142 where a determination is made regarding what is the desired operational current range for the current mirror circuit. In some of the embodiments provided herein the desired current rage was about 10 μA to about 40 μA, but any current range may be selected and is contemplated as falling within the scope of the present disclosure. A simulation is then performed at 144 to determine whether transistors in the output portion of the current mirror circuit (e.g., output cascode transistors M2 and M3 of FIG. 4) remain in saturation across the entire current range determined at 142. If a determination at 146 is affirmative (YES at 146), then the initial weightings given to the first and second current sources (e.g., circuits 46 and 48 in FIG. 4) are sufficient and the design is acceptable at 148, at least with respect to sufficient output resistance $R_{OUT}$ across the entire operating current range.

If at 146 a determination is made that either M2 or M3 do not remain in saturation across the entire operating current range (NO at 146) the current source circuit weightings are adjusted for one or both of the first and second current source circuits (e.g., circuits 46 and 48 in FIG. 4) at 150 of FIG. 13. For example, if the weightings for the two current source circuits were initially the same such that $I_{BIAS}=I_{OPER}$ across the entire range of operating currents, the weightings of the first current source circuit may be varied such as that illustrated in FIG. 9, for example. In such example, the $I_{BIAS}$ vs. $I_{OPER}$ curve is effectively "rotated" about a pivot point (wherein the pivot point represents the point across the current range where the condition $I_{BIAS}=I_{OPER}$ is met), such as that illustrated in FIG. 5 at 54. The $I_{BIAS}$ vs. $I_{OPER}$ curve can be rotated up or down. If rotated as illustrated in FIG. 5, the result is that the rate of change of $I_{OPER}$ is greater than the rate of change of $I_{BIAS}$, as illustrated in FIG. 10. Alternatively, if the curve of FIG. 5 is rotated up, in the opposite direction, the rate of change of $I_{BIAS}$ will be greater than the rate of change of $I_{OPER}$.

In summary, a current mirror circuit comprises an input portion configured to conduct a bias current and a first current source circuit coupled to the input portion. The first current source circuit is configured to generate the bias current, and vary the bias current over a range of currents based on a first group of weightings associated therewith. The current mirror circuit also comprises an output portion configured to conduct an operational current, wherein the output portion is coupled to the input portion. Further, the current mirror circuit comprises a second current source circuit coupled to the output portion. The second current source circuit is configured to generate the operational current, and vary the operational current over a range of currents based on a second group of weightings associated therewith. Lastly, in the current mirror circuit the first group of weightings and the second group of weightings are different.

In addition, a current mirror circuit is disclosed that comprises a first transistor having a drain terminal coupled to a gate terminal thereof, that is configured to conduct a bias current therethrough. The current mirror circuit further comprises a second transistor and a third transistor connected together in series, wherein the third transistor has a drain terminal connected to a gate terminal of the second transistor. The third transistor is connected to the gate terminal of the first transistor. The second and third transistors are configured to conduct an operational current therethrough. Further, the current mirror circuit comprises a first current source circuit coupled to the drain terminal of the first transistor, wherein the first current source circuit is configured to vary the bias current over a range of currents in a first manner. Still further, the current mirror circuit comprises a second current source circuit coupled to the drain terminal of the third transistor, wherein the second current source circuit is configured to vary the operational current over a range of currents in a second manner that is different than the first manner.

Also, a method of optimizing a current mirror circuit for operation over a range of currents is disclosed. The method comprises determining a desired operating current range, and simulating operation of the current mirror circuit over the desired operating current range. The method further comprises ascertaining whether an active device in the current mirror circuit is in a saturation mode of operation over the desired operating current range in the simulated operation, and altering a weighting of a first current source circuit or a second current source circuit, or both, that reside in the current mirror circuit if the active device is not in the saturation mode of operation over the desired operating current range.

While the invention has been illustrated and described with respect to one or more implementations, alterations and/or modifications may be made to the illustrated examples without departing from the spirit and scope of the appended claims. In particular regard to the various functions performed by the above described components or structures (assemblies, devices, circuits, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the invention. In addition, while a particular feature of the invention may have been disclosed with respect to only one of several implementations, such feature may be combined with one or more other features of the other implementations as may be desired and advantageous for any given or particular application. Furthermore, to the extent that the terms "including", "includes", "having", "has", "with", or variants thereof are used in either the detailed description and the claims, such terms are intended to be inclusive in a manner similar to the term "comprising".

What is claimed is:

1. A current mirror circuit, comprising:

a first transistor having a drain terminal coupled to a gate terminal thereof, and configured to conduct a bias current therethrough;

a second transistor and a third transistor connected together in series, the third transistor having a drain terminal connected to a gate terminal of the second transistor, the third transistor is connected to the gate terminal of the first transistor, and wherein the second and third transistors are configured to conduct an operational current therethrough;

a first current source circuit coupled to the drain terminal of the first transistor, wherein the first current source circuit is configured to vary the bias current over a range of currents in a first manner; and a second current source circuit coupled to the drain terminal of the third transistor, wherein the second current source circuit is configured to vary the operational current over a range of currents in a second manner that is different than the first manner.

2. The current mirror circuit of claim 1, wherein the first current source circuit comprises a plurality of programmable current branches coupled together in parallel, wherein at least some of the plurality of programmable current branches are configured to be selectively decoupled via a switch, and wherein a control word is configured to selectively activate or deactivate the switches to program the bias current, and wherein current weightings of the branches comply with a first weighting architecture.

3. The current mirror circuit of claim 2, wherein the second current source circuit comprises a plurality of programmable current branches coupled together in parallel, wherein at least some of the plurality of programmable current branches are configured to be selectively decoupled via a switch, and wherein a control word is configured to selectively activate or deactivate the switches to program the operational current, and wherein current weightings of the branches comply with a second weighting architecture, wherein the first and second weighting architectures are different.

4. The current mirror circuit of claim 1, wherein the second current source varies the operational current over the range of currents differently than the first current source varies the bias current over the range of currents such that the third transistor stays in a saturation mode of operation throughout the range of currents.

5. The current mirror circuit of claim 1, wherein the first current source circuit has a first group of weightings associated with a plurality of selectable paths, wherein the first group of weightings dictate the bias current.

6. The current mirror circuit of claim 5, wherein the second current source circuit has a second group of weightings associated with a plurality of selectable paths, wherein the second group of weightings dictate the operational current, and wherein the first and second group of weightings are different.

7. The current mirror circuit of claim 1, wherein the first current source circuit comprises a plurality of parallel-connected branches, wherein one or more of the branches is selectively coupled to the other branches via a switch, and wherein one of the branches is coupled to the other branches directly with no switch therein.

8. The current mirror of claim 7, wherein an amount of current conducted by each of the plurality of parallel-connected branches is a function of a weighting of each respective branch, and wherein a first group of weightings for the first current source circuit reflects a total of the weightings of each respective branch.

9. The current mirror circuit of claim 1, wherein the second current source circuit comprises a plurality of parallel-connected branches, wherein one or more of the branches is selectively coupled to the other branches via a switch, and wherein one of the branches is coupled to the other branches directly with no switch therein.

10. The current mirror circuit of claim 1, wherein the first current source circuit varies the bias current based on a first group of weightings which cause the bias current to increase over the range of currents at a first rate, and wherein the second current source circuit varies the bias current based on a second group of weightings which cause the operational current to increase over the range of currents at a second rate, wherein the first rate and the second rate are different.

11. A method of optimizing a current mirror circuit for operation over a range of currents, comprising:

determining a desired operating current range;

simulating operation of the current mirror circuit over the desired operating current range;

ascertaining whether an active device in the current mirror circuit is in a saturation mode of operation over the desired operating current range in the simulated operation; and altering a weighting of a first current source circuit or a second current source circuit, or both, that reside in the current mirror circuit if the active device is not in the saturation mode of operation over the desired operating current range.

12. The method of claim 11, wherein the first current source is configured to vary a bias current of the current mirror circuit over a range of currents, and wherein altering the weighting of the first current source comprises varying a rate at which the bias current is varied over the range of currents.

13. The method of claim 11, wherein the second current source is configured to vary an operational current of the current mirror circuit over a range of currents, and wherein altering the weighting of the second current source comprises varying a rate at which the operational current is varied over the range of currents.

14. The method of claim 11, wherein the current mirror comprises an input portion configured to conduct a bias current, an output portion configured to conduct an operational current, the first current source configured to generate the bias current and the second current source configured to generate the operational current.

15. The method of claim 14, wherein the first current source circuit comprises a plurality of parallel weighted, selectively activatable current paths, wherein adjusting a number of the weighted current paths that are activated alters the weighting of the first current source, and thus a rate at which the bias current is varied over the range of currents.

16. The method of claim 14, wherein the second current source circuit comprises a plurality of parallel weighted, selectively activatable current paths, wherein adjusting a number of the weighted current paths that are activated alters the weighting of the second current source, and thus a rate at which the operational current is varied over the range of currents.

17. The current mirror circuit of claim 10, wherein the second rate is greater than the first rate.

18. The method of claim 11, wherein the first or second current source circuit, or both, comprise a plurality of parallel-connected branches, wherein one or more of the branches is selectively coupled to the other branches via a switch, and wherein one of the branches is coupled to the other branches directly with no switch therein.

19. The method of claim 11:

wherein the first current source is configured to vary a bias current of the current mirror circuit over the range of currents, and wherein altering the weighting of the first current source comprises varying a first rate at which the bias current is varied over the range of currents; and wherein the second current source is configured to vary an operational current of the current mirror circuit over the range of currents, and wherein altering the weighting of the second current source comprises varying a second rate at which the operational current is varied over the range of currents, wherein the first and second rates are different.

20. The method of claim 14, wherein the output portion comprises:

a first pair of two series-connected transistors, the first pair of series-connected transistors having gate terminals connected together, the first pair of two series-connected transistors coupled between a supply potential terminal and the second current source circuit, wherein the operational current conducts therethrough; and a second pair of series-connected transistors having gate terminals coupled to gate terminals of the first pair of series-connected transistors, and configured to conduct an output current therethrough that is related to the operational current.

* * * * *